US008240249B2

(12) United States Patent
Otsuka et al.

(10) Patent No.: US 8,240,249 B2
(45) Date of Patent: Aug. 14, 2012

(54) INK ROLLER COVER DEVICE OF PORTABLE TYPE LABEL PRINTING APPLICATOR

(75) Inventors: Masanori Otsuka, Tokyo (JP); Yoshisada Takahashi, Tokyo (JP)

(73) Assignee: Kabushiki Kaisha Sato (JP)

( * ) Notice: Subject to any disclaimer, the term of this patent is extended or adjusted under 35 U.S.C. 154(b) by 384 days.

(21) Appl. No.: 12/525,388

(22) PCT Filed: Jan. 29, 2008

(86) PCT No.: PCT/JP2008/051283

§ 371 (c)(1),
(2), (4) Date: Aug. 14, 2009

(87) PCT Pub. No.: WO2008/102613

PCT Pub. Date: Aug. 28, 2008

(65) Prior Publication Data

US 2010/0032100 A1 Feb. 11, 2010

(30) Foreign Application Priority Data

Feb. 23, 2007 (JP) ..... 2007-043103

(51) Int. Cl.

| | |
|---|---|
| ***B65C 11/02*** | (2006.01) |
| ***B41J 27/10*** | (2006.01) |
| ***B41K 1/42*** | (2006.01) |
| ***B41K 1/58*** | (2006.01) |

(52) U.S. Cl. ..... 101/288; 101/291

(58) Field of Classification Search ..... 101/288, 101/291, 295, 359, 103, 324, 325, 327, 353, 101/348

See application file for complete search history.

(56) References Cited

U.S. PATENT DOCUMENTS 3,785,288 A * 1/1974 Hunter ..... 101/348

(Continued)

FOREIGN PATENT DOCUMENTS

JP 52-044814 9/1950

(Continued)

OTHER PUBLICATIONS

International Search Report dated Mar. 25, 2008, issued in corresponding international application No. PCT/JP2008/051283.

*Primary Examiner* — Judy Nguyen
*Assistant Examiner* — Leo T Hinze
(74) *Attorney, Agent, or Firm* — Ostrolenk Faber LLP

(57) ABSTRACT

An ink roller cover device of a portable type label printing applicator so that the ink does not dry-up easily in stored or standby state by closed storage of the ink roller. An ink roller is stored in a cover including a fixed cover part which can cover and store a part of a roller body in a standby state of the ink roller and a complementary movable cover part which covers and stores the other parts of the roller body when the cover parts are closed in a standby state of the ink roller. The movable cover part is capable of exposing the roller body towards a printing device in an operating state of the ink roller. An operating lever moves the ink roller with the movable cover part away from the fixed cover part.

9 Claims, 6 Drawing Sheets

U.S. PATENT DOCUMENTS

| | | | | | |
|---|---|---|---|---|---|
| 3,817,177 | A | * | 6/1974 | Van Arnam et al. | 101/288 |
| 3,859,915 | A | * | 1/1975 | Hunter | 101/103 |
| 3,902,952 | A | * | 9/1975 | Penaluna | 156/384 |
| 4,051,781 | A | * | 10/1977 | Nishikawa | 101/348 |
| 4,359,940 | A | * | 11/1982 | Sato | 101/295 |
| 4,433,624 | A | * | 2/1984 | Mistyurik | 101/314 |
| 4,478,146 | A | * | 10/1984 | Mistyurik | 101/205 |

FOREIGN PATENT DOCUMENTS

| | | | |
|---|---|---|---|
| JP | 48-55005 | A | 8/1973 |
| JP | 53-53423 | A | 5/1978 |
| JP | 56-12048 | Y2 | 3/1981 |
| JP | 11509/1986 | | 1/1986 |
| JP | 3-26663 | B2 | 4/1991 |

* cited by examiner

INK ROLLER COVER DEVICE OF PORTABLE TYPE LABEL PRINTING APPLICATOR

CROSS REFERENCE TO RELATED APPLICATION

The present application is a 35 U.S.C. §§371 national phase conversion of PCT/JP2008/051283, filed Jan. 29, 2008, which claims priority of Japanese Application No. 2007-043103, filed Feb. 23, 2007, the disclosure of which is incorporated by reference herein. The PCT International Application was published in the Japanese language.

BACKGROUND OF THE INVENTION

1. Technical Field

The present invention relates to an ink roller cover device of a portable type label printing applicator, especially an ink roller cover device of a portable type label printing applicator which device is capable of preventing dry-up of the ink roller.

2. Background Art

In the conventional portable type label printing applicators, an operation lever is operated on the label application device to activate the printing device. The ink roller applies ink to the printing device. Then printing is performed by the printing device stamping onto labels placed on the platen. They are notably used for example in retail stores to indicate the price and other information about the goods.

However, in such a portable type label printing applicator, when the ink roller is mounted on to the label application device in a stored or a standby state where it is not being used, the ink roller is constantly exposed to the air.

Accordingly, ink ingredients are impregnated into the ink rollers. Commonly used are inks that do not dry-up and that are penetration-drying types which when stamp-printed on labels, the ink infiltrates into the paper materials, such as fine quality papers for labels, and then this ink dries.

For fine quality papers for labels used indoor in retail shops, ink-penetrable materials are used together with the penetration-drying type ink. However, for labels applied on goods that are placed especially outside in do-it-yourself stores, weatherproof synthetic papers are used. Since the ink does not penetrate into these weatherproof papers, and the ink is hard to dry after being printed, ink prints may become illegible and may stain the goods if the ink roller is using the conventional penetration-drying type ink.

Accordingly, for ink rollers for outdoor use, the ink used is not a penetration-drying type ink but a quick-drying type. However, due to quick-drying of the ink, in the above described stored or standby states, the ink roller easily dries up, resulting in a problem of not being able to use it.

In addition, and not only limited to ink rollers for printing labels for indoor or outdoor use, the surface of the ink roller easily collects dirt and dust, and then attaches the dirt and dust to the printing characters of the printing device, thereby causing a problem of carelessly staining the stamped printing.

Reference is made to Patent Document 1: Japanese Examined Patent Application, Publication No. 1991-26663.

SUMMARY OF INVENTION

Technical Problem

The present invention has been achieved in view of the above-mentioned problems. Accordingly, it is an object of the present invention to provide an ink roller cover device of a portable type label printing applicator in which the ink is prevented from drying-up easily, even if the characteristics of the ink used for the ink roller is quick-drying or non-penetrable to fine quality papers, etc., even in its stored or standby state.

Another object of the present invention is to provide an ink roller cover device of a portable type label printing applicator of which the ink roller can withstand not only indoor but also outdoor use.

Another object of the present invention is to provide an ink roller cover device of a portable type label printing applicator which will prevent carelessly staining the printing by dirt and dust attached to the printing characters of the printing device.

Another object of the present invention is to provide an ink roller cover device of a portable type label printing applicator with closed storage of the ink roller capable of shutting off the air in stored or standby state.

Solution to Problem

More specifically, the present invention is focused on the storage of an ink roller inside a half-cut tubular form casing (cover) provided in a label applicator. It is an ink roller cover device of a portable type label printing applicator including a label application device, an operation lever for operating the label application device, a printing device activated by the operation of the operation lever, an ink roller which applies the ink to the printing device by the operation of the operation lever, a fixed cover installed and fixed to the label application device which can store a part of a roller body in a standby state of the ink roller, and a movable cover which stores the remaining parts of the roller body and capable of a closed storage of the roller body between the movable and the fixed covers in standby state of the ink roller, enabling exposure of the roller body towards the printing device in an operating state.

Both the above-mentioned fixed and the movable covers are semicircular in cross section and are capable of forming an enclosed space for closed storage of the ink roller inside thereof.

The above-mentioned ink roller includes a roller shaft rotating the roller body, a pair of right and left side blades positioned on right and left sides of the roller shaft protecting both sides of the roller body, wherein the above fixed cover, the movable cover and the side blades are capable of forming an enclosed space for a closed storage of the ink roller inside thereof.

The movable cover may be provided integrally with the ink roller.

A biasing member to bias the movable cover towards the fixed cover may be provided.

Advantageous Effects of Invention

According to an ink roller cover device of a portable type label printing applicator of the present invention, a fixed cover and a movable cover is provided to enable a closed storage of the roller inside thereof, such that under stored or standby state of the portable type label printing applicator, drying-up of the ink is prevented, and when in operation state, the ink roller is released from the closed storage for applying the ink to the printing device.

In other words, the said ink roller is reciprocating between a first state, wherein the ink roller is stored closed inside the fixed and the movable cover in stored or standby state, and a second state, wherein the ink roller is in actual usage state away from the fixed cover.

Therefore, it is possible to prevent drying-up of the ink used for the ink roller, enabling the usage of a portable type label printing applicator with an ink roller using a quick-drying ink, not only for indoor but also for outdoor use.

DESCRIPTION OF EMBODIMENTS

In the present invention, provided are a fixed cover installed on the label applicator and a movable cover which comes in contact with and moves away from the fixed cover. This achieves an ink roller cover device of a portable type label printing applicator with an ink roller which, without the configuration of the device becoming complex, prevents the ink of the ink roller from drying-up and is not affected by the types of the ink used and where the ink is used.

Embodiments

Hereinafter, according to embodiments of the present invention, a detailed description of a portable type label printing applicator 1 equipped with an ink roller cover device 7 will be explained with reference to the FIGS. 1 to 6.

Figure 1:
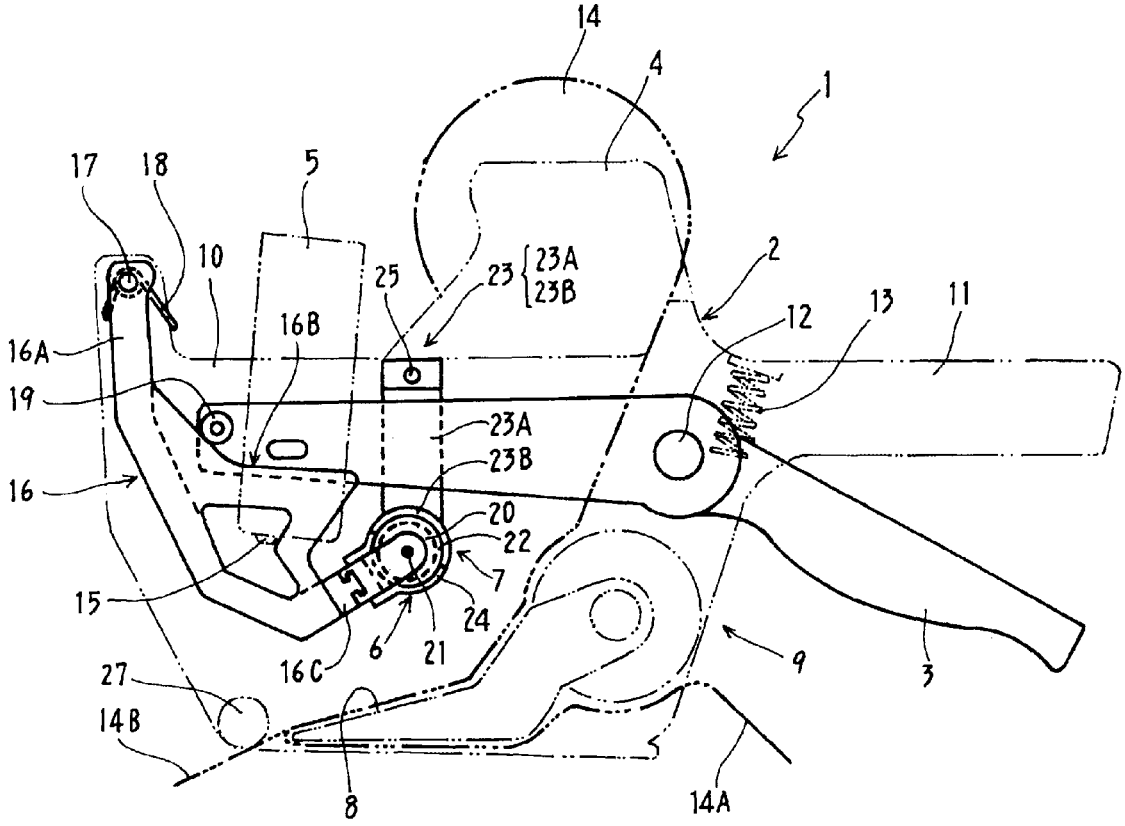
FIG. 1 is a schematic side view diagram of the portable type label printing applicator 1 equipped with an ink roller cover device 7 according to one embodiment of the present invention.
Figure 2:
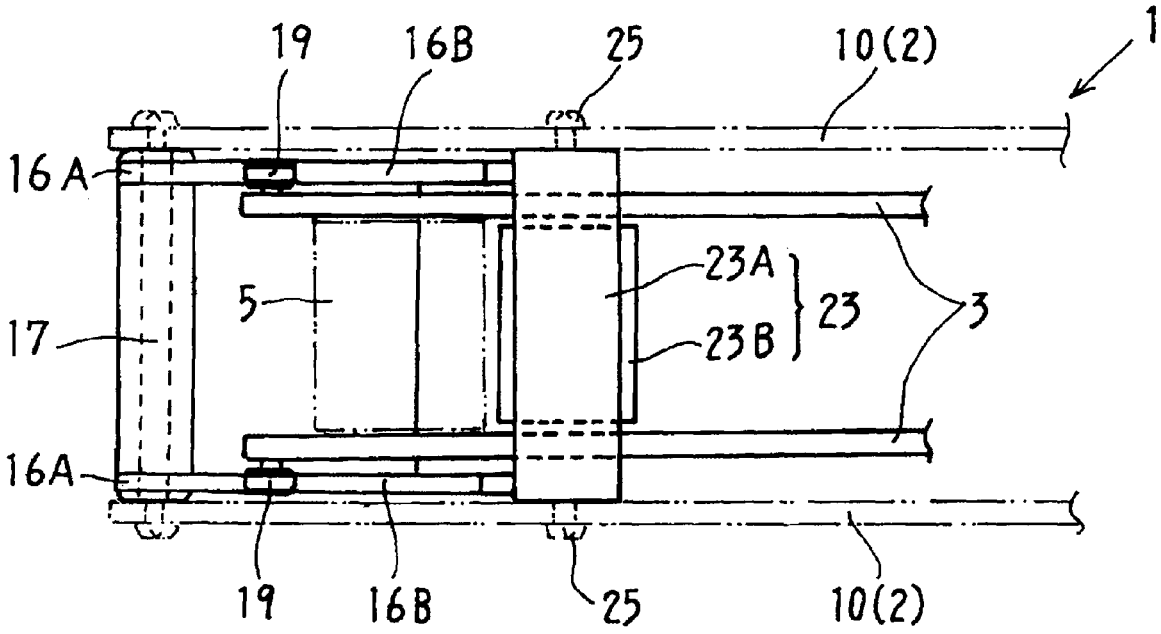
FIG. 2 is a schematic plain view diagram of the substantial parts of the portable type label printing applicator 1 equipped with an ink roller cover device 7 according to one embodiment of the present invention.
Figure 3:
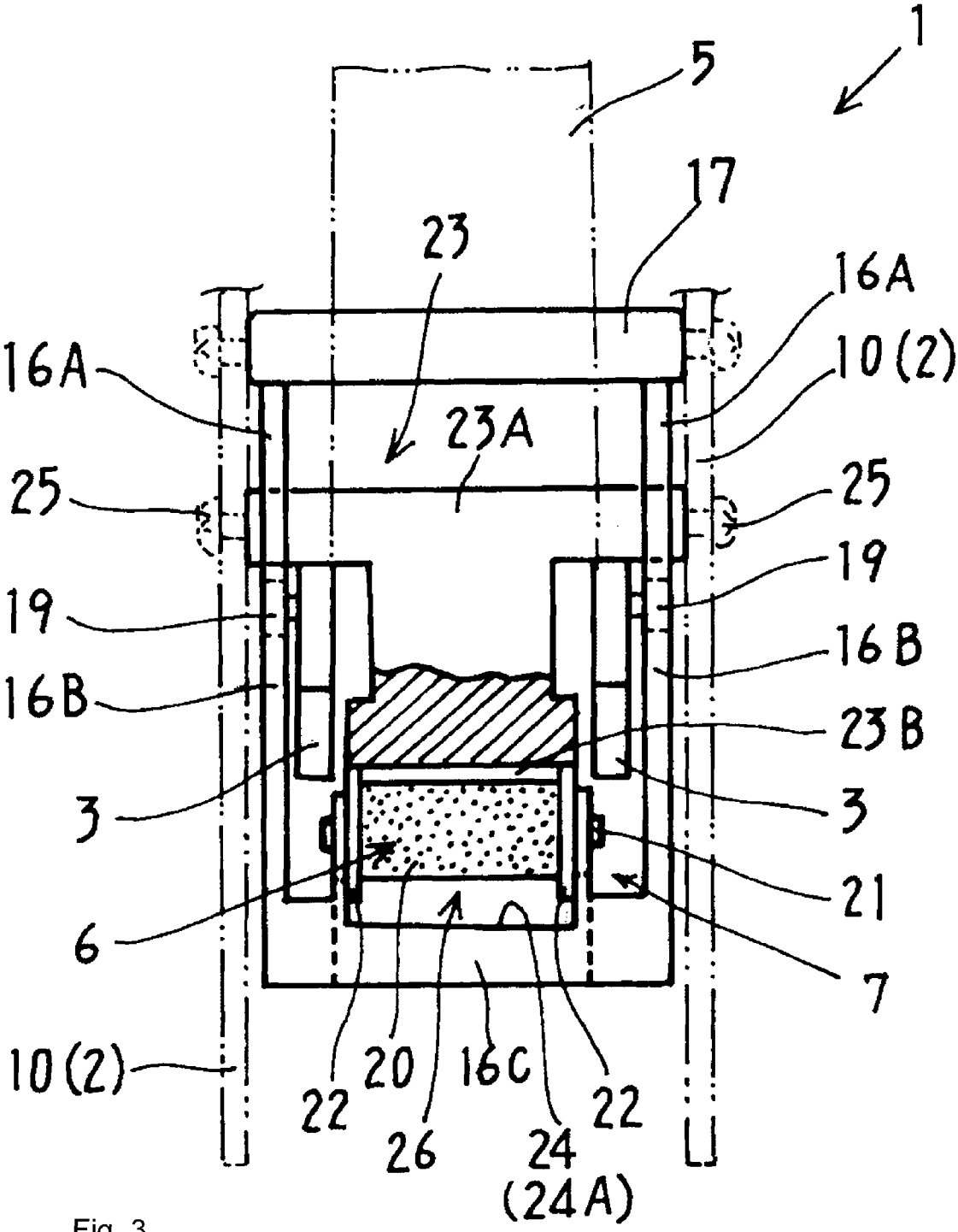
FIG. 3 is a partially cut out front view diagram of the substantial parts of the portable type label printing applicator 1 equipped with an ink roller cover device 7 according to one embodiment of the present invention.

FIG. 1 is a schematic side view diagram of the portable type label printing applicator 1. FIG. 2 is a schematic plain view diagram of the substantial parts of the same. FIG. 3 is a partially cut out front view diagram of the substantial parts of the same. The portable label printing applicator 1 includes a label application device 2, an operation lever 3, a label holder 4, a printing device 5, an ink roller 6, an ink roller cover device 7, a platen 8 and a conveyer 9.

The label application device 2 has a pair of right and left body side boards 10 (FIGS. 2 and 3), and a handle 11 extending backward from the body side boards 10.

The operation lever 3 is rotatable around the axis 12 provided in the label application device 2, and by holding the operation lever 3 against the biasing force of the pushing spring 13 provided between the handle 11 and the operation lever 3, the label application device 2 is operated activating the printing device 5, the ink roller 6, the ink roller cover device 7 and the conveyer 9.

The label holder 4 holds the continuous label strip 14 in a roll, enabling to pay it out in a strip shape form towards the conveyer 9, the printing device 5 and the platen 8.

The printing device 5 is provided on the forefront side of the operation lever 3 and is capable of moving vertically in FIG. 1 following the operation of the operation lever 3. Printing on the continuous label strip 14 on the platen 8 may be performed by choosing any printing characters 15 and transferring the ink from the ink roller 6 to the printing characters 15.

The ink roller 6 applies the ink to the printing device 5 and is replaceably fixed to the tip of the roller holder 16.

The roller holder 16 is swingable around the swing shaft 17, and is consistently biasing the ink roller 6 towards the printing characters 15 of the printing device 5 by the biasing force of the coil spring 18 (biasing member) provided at the swing shaft 17.

Specifically, the roller holder 16 includes a pair of right and left shaft jointing parts 16A swinging around the swing shaft 17 under the biasing force of the coil spring 18, a pair of right and left guiding parts 16B held down by a pair of right and left operation guiding rollers 19 provided on the end of the operation lever 3, and a roller attaching part 16C replaceably fixing the ink roller 6 while lying astride on the guiding parts 16B.

More specifically as shown in FIG. 3, the ink roller 6 includes a roller body 20 retaining or impregnating ink, a roller shaft 21 freely rolling the roller body 20, and side plates 22 positioned on right and left sides of the roller shaft 21, protecting the roller body 20 such that it is closed and protected by the ink roller cover device 7 in stored or standby state.

Figure 4:
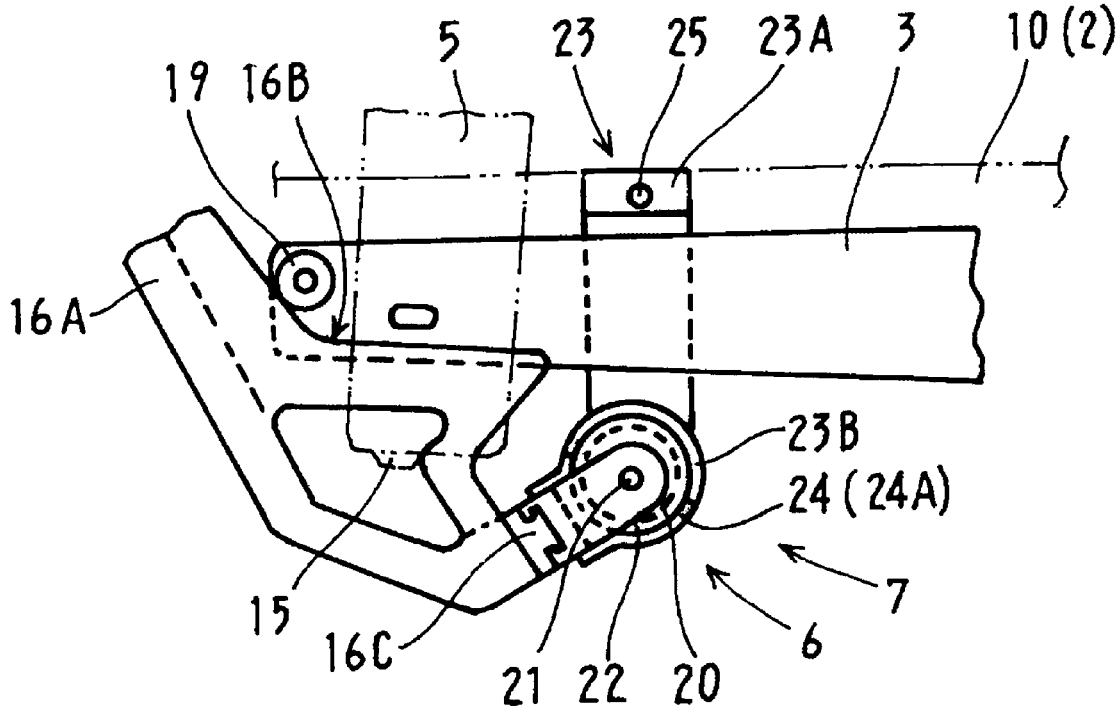
FIG. 4 is a schematic side view of the substantial parts of the portable type label printing applicator 1 equipped with an ink roller cover device 7 according to one embodiment of the present invention, illustrating a standby state of the ink roller 6.
Figure 5:
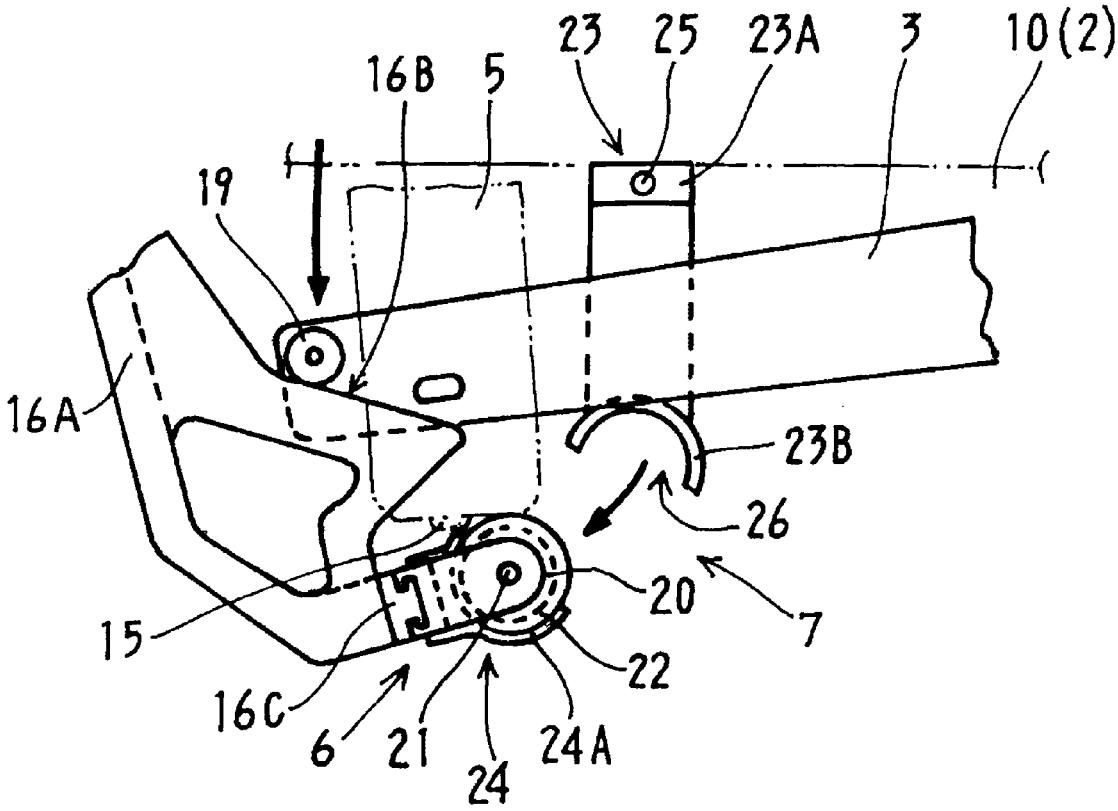
FIG. 5 is a schematic side view of the substantial parts of the portable type label printing applicator 1 equipped with an ink roller cover device 7 according to one embodiment of the present invention, illustrating a state of a printing device 5 and an ink roller 6 starting to move as an operation lever 3 and a handle 11 are held.
Figure 6:
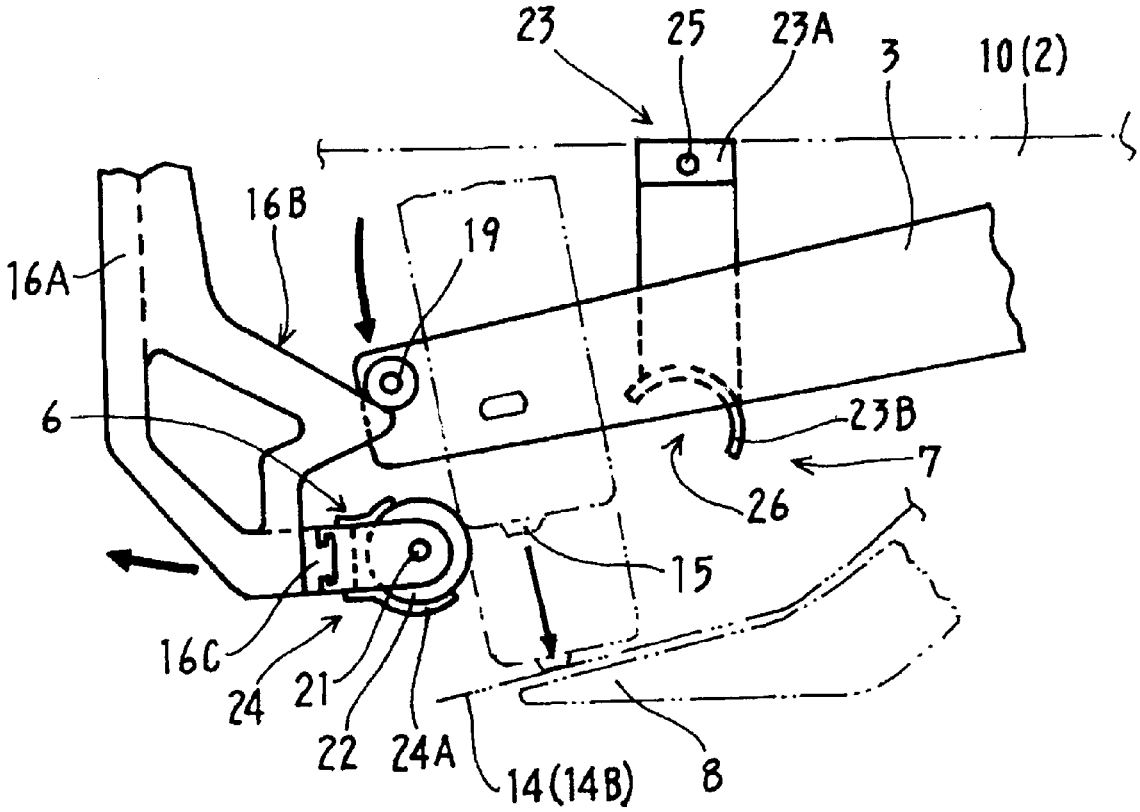
FIG. 6 is a schematic side view of the substantial parts of the portable type label printing applicator 1 equipped with an ink roller cover device 7 according to one embodiment of the present invention, illustrating a state of the printing device 5 printing on a continuous label strip 14 on a platen 8.

FIGS. 4, 5 and 6 are drawings illustrating the substantial parts and the operation process of the ink roller cover device 7. FIG. 4 is a schematic side view of the substantial parts illustrating an ink roller 6 in a standby state. FIG. 5 is a schematic side view of the substantial parts illustrating a state of a printing device 5 and an ink roller 6 starting to move as an operation lever 3 and a handle 11 are held. FIG. 6 is a schematic side view of the substantial parts illustrating a state of the printing device 5 printing on a continuous label strip 14 on a platen 8.

The said ink roller cover device 7 includes a fixed cover 23, a movable cover 24, the above coil spring 18 (biasing member) consistently biasing the movable cover 24 towards the fixed cover 23.

The fixed cover 23 includes a fixing part 23A fixed by a fixing screw 25 to the label application device 2 lying astride on a pair of right and left body side boards 10, and a half circular section roller storage part 23B, integrally located with the fixing part 23A in its lower part, capable of storing a part of the roller body 20 (the upper part of FIG. 1) in a standby state of the ink roller 6.

The movable cover 24 works as a kind of an opening-closing cover of the fixed cover 23 which is integrally provided with the ink roller 6 (a roller fixing part 16C of the roller holder 16). It includes a semicircular cross-sectional roller protection part 24A storing and protecting the other parts (the lower part of FIG. 1) of the roller body 20, wherein the movable cover 24 is capable of closed storage of the roller body 20 between the movable cover 24 and the fixed cover 23 in said standby state, and also capable of exposing the roller body 20 towards the printing device 5 in an operating state of the ink roller 6.

In other words, in a standby state of the ink roller 6 (FIG. 4), the fixed cover 23, the movable cover 24 and the pair of side plates 22 are capable of forming an enclosed space 26 for a closed storage of the ink roller 6 inside, with the coil spring 18 closing the enclosed space 26 by a predetermined pressing force.

In addition, by forming the fixed cover 23 and the movable cover 24 together with the side plates 22 to cover the roller body 20, with only the fixed cover 23 and the movable cover 24, an enclosed space 26 for a closed storage of the ink roller 6 may be formed therein.

The platen 8, on the surface conveys the continuous label strip 14, is incorporated into the conveying device 9, and as already described, will be the base when printing onto the continuous label strip 14 by the printing device 5.

The conveying device 9 conveys the continuous label strip 14 from the label holder 4 to the platen 8, and turning only the backing strip 14A of the continuous label strip 14 at the tip of the platen 8 releasing a label piece 14B temporally adhered to the backing strip 14A, enables to apply the label piece 14B by the application roller 27.

Hereinafter, the standby state and the operation state of the ink roller 6 for a portable label printing applicator 1 and an ink roller cover device 7 with such configuration are described according to FIGS. 4 to 6.

As illustrated in FIG. 4, in the standby state of the ink roller 6, the roller holder 16 is biasing the ink roller 6 towards the printing device 5 by the biasing force of the coil spring 18. The movable cover 24 is abutting against the roller storage part 23B of the fixed cover 23 by a predetermined pressing force, and the side plates 22 of the ink roller 6 also abutting against the side of the roller storage part 23B by a predetermined pressing force, thereby maintaining the enclosed space 26 storing the roller body 20 of the ink roller 6 in a closed state.

Therefore, the roller body 20 of the ink roller 6 is protected without being exposed to the air, and the drying-up of the ink is prevented.

Particularly, as it is hard to dry, even when a quick-drying ink or a non-penetration-drying type ink is used, there will be no problem even in outdoor use of the portable type label printing applicator 1 equipped with the said ink roller 6.

As shown in FIG. 5, when holding the operation lever 3, the printing device moves downward towards the platen 8, the guiding roller 19 presses down the guiding parts 16B of the roller holder 16, and the ink roller 6 together with the movable cover 24 of the ink roller cover device 7 detaches from the fixed cover 23 releasing the ink roller 6 (particularly its upper part) from the enclosed space 26, and the ink roller 6 rotates and applies the ink to the printing characters 15 of the printing device 5.

As shown in FIG. 6, the printing device 5 performs printing on the continuous label strip 14 (label piece 14B) on the platen 8 when the ink roller 6 is completely detached and backed away from the printing device 5.

In addition, by releasing the grip of the operation lever 3, the conveying device 9 further conveys the continuous label strip 14 and places one piece of the label piece 14B released from the backing strip 14A to the lower part of the application roller 27, and by the application roller 27, a label piece 14B can be applied pressing the label piece 14B against the designated goods (not shown).

This way, as the ink provided in a portable label printing applicator 1 is prevented from drying-up in stored or standby state of the ink roller 6, and as the ink can be applied with the usual operation even in usage state, an ink roller cover device 7 may be provided with only a minor change in configuration.

In addition, regardless of the characteristics of the ink, it can prevent the ink roller 6 from collecting dirt and dust.

The invention claimed is:

1. A portable label printing applicator including:

a label application device positioned and configured to apply a label to an object;

an operation lever positioned and configured to operate the label application device;

a printing device connected to and activated by the operation of the operation lever so as to print a label;

an ink roller comprising a body configured to retain ink and to apply ink to the printing device;

the operation lever being configured to move the ink roller by the operation of the operation lever from a standby state to an operating state in which the ink roller applies ink to the printing device;

a fixed ink roller cover fixed to the label application device, the fixed cover is shaped, configured and positioned to store a first portion of the ink roller body in the standby state of the ink roller;

a movable ink roller cover shaped and configured to store a second portion of the ink roller, the movable ink roller being positioned and configured to cooperate with the fixed cover for together providing closed storage of the ink roller body between the movable and the fixed covers in the standby state of the ink roller; and the fixed cover being positioned to remain fixed so as to expose the ink roller body towards the printing device in the operating state of the ink roller when the ink roller is moved away from the fixed cover by the operation of the operation lever.

2. The portable label printing applicator according to claim 1, wherein both the fixed and the movable covers are semi-circular in cross section, are open toward each other and in the standby state together form an enclosed space for the closed storage of the ink roller body inside the covers.

3. The portable label printing applicator according to claim 1, wherein the ink roller includes:

a roller shaft configured such that the ink roller body rotates on the roller shaft;

a right side blade and a left side blade positioned, respectively, on right and left sides of the roller shaft and of the roller body and being shaped and configured to protect both sides of the roller body, wherein the fixed cover, the movable cover and the side blades are together configured to form an enclosed space for the closed storage of the ink roller inside the space.

4. The portable label printing applicator according to claim 1, wherein the movable cover is provided at the ink roller to move therewith from the standby state to the operating state.

5. The portable label printing applicator according to claim 1, further comprising:

a biasing member configured to bias the movable cover towards the fixed cover, and the operation lever is configured and operable to move the movable cover away from the fixed cover.

6. The portable label printing applicator according to claim 1, wherein the fixed and the movable covers together form an enclosed space shaped and configured for the closed storage of the ink roller body inside thereof.

7. The portable label printing applicator according to claim 6, wherein the fixed ink roller cover covers the first portion of the ink roller body that is exposed to apply ink to the printing device in the operating state of the ink roller.

8. The portable label printing applicator according to claim 1, wherein the fixed ink roller cover covers the first portion of the ink roller body that is exposed to apply ink to the printing device in the operating state of the ink roller.

9. The portable label printing applicator according to claim 1, wherein the ink roller body is positioned on a movable arm positioned and configured to move from the ink roller body standby state to the operating state, and the moveable arm is connected with the operation lever which moves the moveable arm.

* * * * *